US005413381A

United States Patent [19]

Beeuwkes, III et al.

[11] Patent Number: 5,413,381

[45] Date of Patent: May 9, 1995

[54] ADHESIVE BOUND PAD OF PAPER AND METHOD OF MANUFACTURE THEREOF

[75] Inventors: Reinier Beeuwkes, III, Concord; Thomas E. Salisbury, Wayland; Robert C. Gorin, Newton Centre, all of Mass.

[73] Assignee: Innoves, Inc., Concord, Mass.

[21] Appl. No.: 75,379

[22] Filed: Jun. 14, 1993

[51] Int. Cl.[6] ..... B42D 1/10; B42C 9/00

[52] U.S. Cl. ..... 281/21.1; 281/51; 156/908; 402/58; 402/79; 402/80 R; 412/8

[58] Field of Search ..... 281/21.1, 28, 51, 15.1; 402/21, 58, 59, 62, 68, 79, 80 R; 412/6, 8, 33, 37, 901; 462/55, 900; 156/212, 245, 249, 908

[56] References Cited

U.S. PATENT DOCUMENTS

| | | | |
|---|---|---|---|
| 2,914,318 | 11/1959 | McGarvey et al. | 412/8 X |
| 4,106,148 | 8/1978 | Axelrod | 412/8 |
| 4,749,427 | 6/1988 | Pitts et al. | 412/8 |
| 5,129,772 | 7/1992 | Slautterback | 156/908 X |

FOREIGN PATENT DOCUMENTS

| | | | |
|---|---|---|---|
| 4008044 | 9/1991 | Germany | 412/37 |
| 1164069 | 6/1985 | U.S.S.R. | 412/8 |

*Primary Examiner*—Peter Dungba Vo
*Attorney, Agent, or Firm*—James L. Jackson

[57] ABSTRACT

An adhesive bound pad of paper such as loose leaf binder paper is provided which is secured in assembly by adhesive material, lining or partially lining holes along selected edges of the paper stack forming the pad. The edges of the paper pad remain free of adhesive material and thus are not distorted upon separation of the sheets from the pad. The adhesive bound pad is manufactured by assembling a selected number of sheets of paper into a stack and drilling or otherwise forming holes, such as binder holes, along one of the edges of the stack. Thereafter, the coating of adhesive material is applied within the holes of the stack so as to entirely coat the paper at the holes or to coat selected portions of the paper at the holes as desired. After the adhesive material has been allowed to cure or has been cured the paper is releasably retained in adhesive bound pad form and the manufacturing process is complete. Individual sheets of paper may be pulled away from the pad. The adhesive material may also provide reinforcement for the paper at the hole, especially in the case of loose leaf binder paper.

14 Claims, 1 Drawing Sheet

FIG. 1
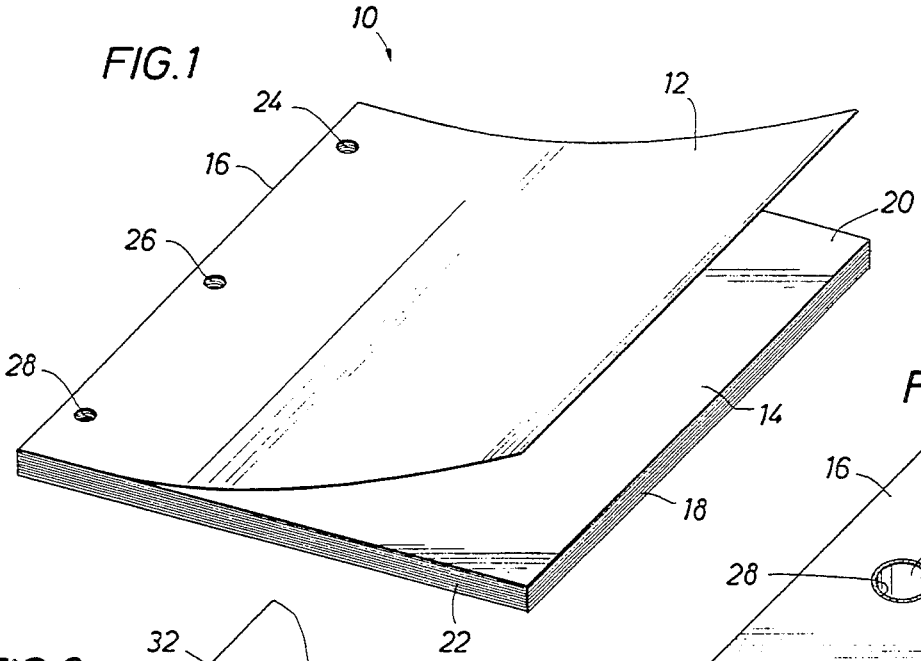
FIG. 2
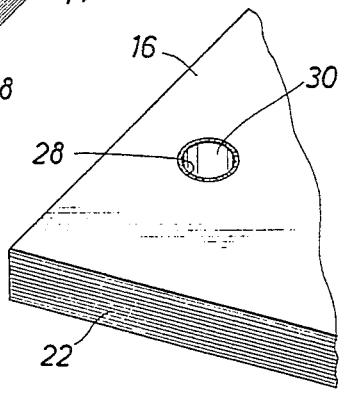
FIG. 3
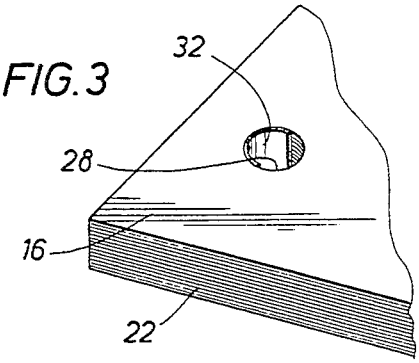
FIG. 4
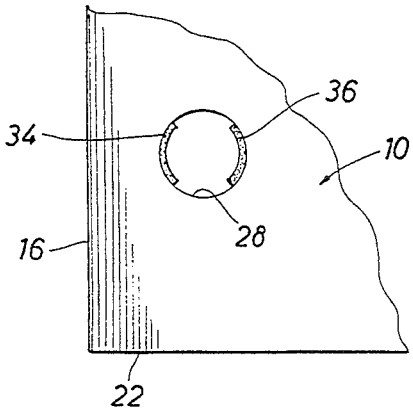
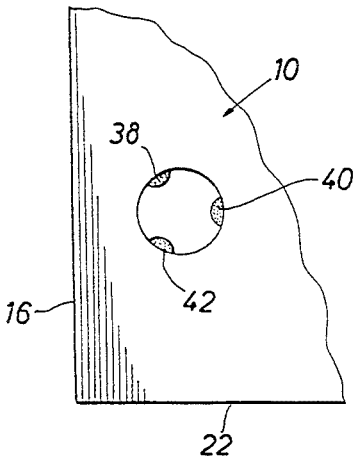
FIG. 5
FIG. 6
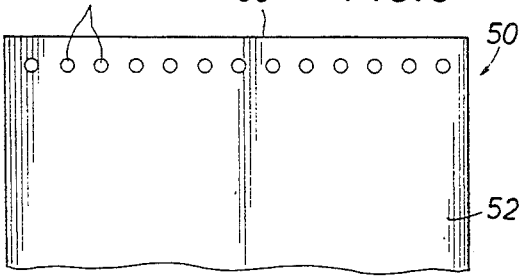

ADHESIVE BOUND PAD OF PAPER AND METHOD OF MANUFACTURE THEREOF

FIELD OF THE INVENTION

This invention relates generally to paper that is provided in the form of integral pads having adhesively attached sheets and enabling individual sheets of paper to be separated from the pad as desired. More specifically, the present invention concerns pads of paper having adhesive material only within holes of the pad, such as in loose leaf binder holes, for securing the paper sheets in pad form and for providing reinforcement for the binder paper about the binder holes.

BACKGROUND OF THE INVENTION

Although this invention is discussed herein particularly as it relates to loose leaf binder paper, it should be borne in mind that the scope of this invention is intended to encompass many different types of paper pads wherein paper sheets of pads are held in assembly by means of an adhesive which is located within holes of the pad. Loose leaf binder paper has for many years been assembled in pad form by assembling the paper in a stack and by applying adhesive along one of the edges of the pad to create a spine for the pad and to permit individual sheets of paper to be removed as desired. Loose leaf paper is typically bound in this manner along its inner edge adjacent the loose leaf binder holes. The paper sheets of writing pads are typically bound along the top edge and frequently are perforated for tearing to avoid the presence of adhesive residue at the edges. Typically when sheets of paper are removed from this type of paper pad a small residual amount of adhesive material remains on the edges of the sheets that are separated from the pad. This residual adhesive material, though frequently tolerated, nevertheless typically remains a nuisance to the user because it adds undesirable thickness to the edge of the paper and because it can interfere with serial feeding of the paper through copier and facsimile machines. To provide adhesive bound loose leaf pads of this nature and to ensure relatively clean edges for the paper that is removed from the pad by tearing the sheets away from the adhesive, the adhesive material may be reinforced with a fabric so that virtually all of it will remain in assembly with the spine when the paper sheets are torn away. Frequently however, the adhesive material establishes sufficient retention with the edges of the sheets that the edges can be torn or frayed as the sheets of paper are removed from the adhesive spine of the pad. Because loose leaf paper is typically adhesive bound along its inner edge by an adhesive spine, the entire pad must be removed from a loose leaf binder before a sheet can be removed therefrom.

It is desirable to provide loose leaf binder pads of paper that are efficiently adhered in assembly to form an integral loose leaf binder pad and which can be efficiently separated from the pad so as to leave a clean, sharp and uncontaminated edge for each of the sheets of paper that are so removed. It is also desirable to provide adhesive bound pads of loose leaf binder paper which utilizes the structural integrity of the adhesive material as a reinforcement for the loose leaf binder holes of the paper. Further, it is desirable to provide adhesive bound pads of loose leaf binder paper which enables sheets of paper to be removed from the pad while the pad is in assembly with a loose leaf binder. It is also desirable to provide pads of adhesively interconnected sheets of paper, such as for loose leaf binder pads, writing pads and the like which enable sheets of paper, removed from the pad, to have sharp, straight, clean and uncontaminated edges.

SUMMARY OF THE INVENTION

It is a principle feature of the present invention to provide a novel pad of adhesive assembled paper which is bound by adhesive material only at openings of the stacked sheets of paper to thus permit efficient separation of the sheets of the paper from the pad in a manner permitting each of the separated sheets to have sharp, straight and uncontaminated edges.

It is also a principle of this invention to provide a novel pad of stacked, adhesively bound paper having holes adjacent one of the edges wherein the inside surfaces of the holes of the sheets are lined with adhesive to ensure that all four edges of each of the removed sheets will have sharp, straight edges.

It is another feature of this invention to provide a novel adhesive bound loose leaf binder pad of paper wherein selected sections of the binder holes of the paper stack defining the pad are coated to permit efficiency of sheet removal from the pad and to facilitate reinforcement of the loose leaf binder holes of each of the sheets of paper forming the adhesive bound pad.

It is another feature of the present invention to provide a novel method for assembling sheets of paper into a pad by applying adhesive material within the registering holes of the paper sheets of the assembled pad to secure the multiple sheets of paper in removable assembly.

It is an even further feature of this invention to provide a novel method for assembling adhesive bound pads of loose leaf binder paper in such a manner that selected sections of the registering loose leaf binder holes of the sheets of paper are coated with strips of adhesive material to facilitate ease of paper separation from the loose leaf binder pad.

It is also a feature of this invention to provide a novel adhesive bound pad of loose leaf binder paper wherein individual sheets may be separated from the pad while the pad is in assembly with the binder rings of a loose leaf binder.

Briefly adhesive bound pads of paper, such as loose leaf binder paper, are assembled to form a stack having a desired number of sheets. These stacks of paper, with or without a more rigid paper binding, i.e. cardboard, are drilled along one of the edges of the assembled stack to define registering holes in each of the sheets of paper of the stack. For binding the sheets of paper of the stack into a pad a quantity of binding cement is applied to provide an integral coating of the inner surface of the drilled holes, with the binding cement establishing adhesive contact with each of the sheets of paper at the registering holes. This binding cement secures each of the sheets of paper in assembly with the adjacent sheet and permits one or more sheets of paper to be selectively removed from the pad simply by pulling the sheets away from the pad. When so removed, the edges of the paper will remain sharp and straight and will be free of any adhesive residue. Although the binding cement may form an integral coating lining the entire inner periphery of each of the drilled holes of the stack of paper, the binding cement may also be applied so as to provide coating for only selected portions of the drilled or formed holes in the stack of paper. For example, the binding cement may coat only those portions of the formed holes that are located adjacent an edge of the pad. This enables the binding cement, especially in the case of loose leaf binder paper, to also function as structural reinforcement for the sheets of paper at the loose leaf binder holes to thereby provide resistance against inadvertent tearing of the paper at the loose leaf binder holes. Thus, by selective application of the binding cement at specific locations within the formed loose leaf binder holes of the pad and by controlling the structural integrity of the cured binding cement and its relation with the paper, residual binding cement may remain on the paper at the loose leaf binder holes and provide structural reinforcement of the paper at the binder holes.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an isometric illustration of an adhesive bound pad of loose leaf binder paper that is constructed in accordance with the present invention.

FIG. 2 is a partial isometric illustration similar to that of FIG. 1 and illustrating a paper binding coating on the inner surface of the loose leaf binder holes of a paper stack forming the pad.

FIG. 3 is a partial isometric illustration similar to that of FIG. 2 and showing coating of only a selected portion of the registering holes of a paper stack to facilitate efficient separation of individual sheets from the adhesive bound pad structure.

FIG. 4 is a fragmentary plan view of a stack of paper sheets as shown in FIGS. 1–3 and illustrating adhesive application on opposed sides of the formed registering holes of a stack of paper sheets.

FIG. 5 is a fragmentary plan illustration similar to that of FIG. 4 and showing three internal strips of binding cement for securing the multiple sheets of the pad in releasable assembly.

FIG. 6 is a partial plan view of a pad Of paper representing an alternative embodiment of this invention and having multiple adhesive lined holes for securing the multiple sheets in pad form.

DETAILED DESCRIPTION OF PREFERRED EMBODIMENT

For purposes of simplicity to facilitate ready understanding of this invention, this specification is directed for the most part to pads of loose leaf binder paper. The scope and breadth of this invention is intended to encompass any pads of paper sheets which employ adhesive in holes to secure the sheets in removable assembly.

Referring now to the drawings and first to FIG. 1, a pad of loose leaf binder paper is shown generally at 10 which includes multiple sheets of paper 12 which are assembled to form a paper stack 14 having registering inner and outer edges 16 and 18 respectively and upper and lower edges 20 and 22.

Typically in the forming of adhesive bound pads of loose leaf binder paper, after the paper has been appropriately stacked it is drilled or otherwise formed so as to define a plurality of loose leaf binder holes such as shown at 24, 26 and 28. Although these binder holes may be formed by punching activities it is typically more practical from a manufacturing standpoint to form them by drilling. The holes are shown to be of circular configuration but they may be of any other desirable configuration within the scope of the invention. When the holes are drilled in the stacked sheets the registering circular edges of the sheets of paper defining the binder holes typically establish an essentially internal cylindrical surface of each of the binder holes of the paper stack. In the case of holes of other configurations the internal surfaces of the paper stack may have any desired configuration. This internal cylindrical or other surface is defined by the edges of each of the holes of each of the sheets of paper. Heretofore for adhesive assembly of the paper into an integral pad a quantity of binding cement is applied along one of the edges of the stack of paper, such as the inner edge 16. Writing pads are typically adhesively bound at the upper edge. This integral coating defines a spine for the pad of paper at its desired edge and establishes adhesive contact with each of the sheets of paper along the respective edges thereof. In the case of loose leaf binder paper, the sheets are typically bound along the inner edges thereof. As mentioned above, when the paper is removed from the pad by tearing it away from this elongate inner edge spine the edges can become torn or frayed such that the paper becomes uneven and unsightly. In other cases, a quantity of the binding cement remains adhered to the edge portion of the pages and represents a nuisance because it adds to the thickness of the pages at the inner edges thereof. Its adherence to the inner edges of the pages is usually only partial so that the edges become unsightly. Further, paper with variations in edge thickness typically have difficulty being handled serially by copy machines and facsimile machines. For these reasons, edge bound paper is considered less than desirable for pads of paper such as loose leaf binder pads.

According to the principles of the present invention, after the binder holes are drilled or otherwise formed in the stack of paper sheets forming the loose leaf binder pad, a quantity of binder cement is applied to the inner surfaces of the binder holes of the pad and thus provides an integral coating for the holes of the pad with the coating being disposed in adhesive assembly with each of the sheets of paper at the peripheral edges of the holes. The inside edges 16 as well as the outside, top and bottom edges of the pad of paper will be free of adhesive material of any kind. Thus all of the edges will always remain sharp and straight and will not become frayed or otherwise distorted as the sheets of paper are separated from the pad. As each of the sheets is serially separated from the pad the coating of binding cement is broken only at the holes. The sheets are capable of being easily separated from the pad because the retention force of the binding of cement is sufficient to secure the sheets of paper in releasable assembly with one another. Further, in the case of loose leaf binder paper, the sheets may be separated from the binder pad while the pad is in assembly with the binder rings of a loose leaf binder. This is not possible with edge bound sheets of binder paper.

It is also within the scope of the present invention to provide binding cement for coating the inner surfaces of the cylindrical holes of the assembled loose leaf binder pad in such a manner that the binding cement establishes reinforcement with the paper about each of the binder holes of each of the sheets of paper, thus enhancing the structural integrity of the paper to provide resistance against tearing of the paper at the loose leaf binder holes. As shown in FIG. 2 an internal coating 30 of binding cement is provided within the loose leaf binder holes as shown at 28. The coating 30 is of integral nature and thus establishes adhesive contact with each of the sheets of paper of the assembled loose leaf binder pad. When a sheet of paper is separated from the pad the adhesive material lining the holes of the paper will remain with the paper.

As shown in FIG. 3 it may be desirable to coat only a portion of the cylindrical drilled or formed holes of the loose leaf binder pads. As shown, a coating 32 of binding cement is placed within the drilled hole so that it coats only a portion, one-half for example, of the internal cylindrical surface defined by the multiple holes in the assembled loose leaf binder sheets. Thus, a portion of the paper at the binder holes is connected in cemented assembly while opposite portions of the binder paper at the holes is free. This feature permits the paper of the loose leaf binder pads to be very easily separated from the binding cement even when the pad of paper is in assembly with the binder tings of a loose leaf binder.

With reference now to FIG. 4, the fragmentary plan illustration shows a pad of binder paper 10 defined by stacked sheets of paper which have been drilled or otherwise formed to define binder openings such as shown at 28. In the case of FIG. 4, adhesive strips of binding cement 34 and 36 are provided on opposed sides of the binder hole 28 with the strips having adhesive contact with each of the sheets of paper of the pad. The binding strips of cement 34 and 36 are located diametrically opposite one another with the binding strip 34 being located adjacent the inner edge 16 of the loose leaf binder pad. A paper pad that is constructed in accordance with FIG. 4 may be easily torn away from top to bottom or from bottom to top and may also be separated from the loose leaf binder pad by tearing or peeling from the outer edge toward the inner edge. Here again, the inner strip of binding cement 34 may provide for enhanced structural integrity of the paper at the inner edge thereof so as to resist tearing by a loose leaf binder.

With reference now to FIG. 5 a loose leaf binder pad 10 is shown which is essentially the same as shown in FIG. 4 except that oriented, spaced strips of adhesive material 38, 40 and 42 are provided at selective inner portions of the drilled binder holes to provide for efficient retention of the multiple sheets of paper in assembly to form the binder pad. Each of the strips of binder cement establishes adhesive contact with each of the sheets of paper. Thus, each of the sheets of paper is bound at three points internally of the respective binder holes, thus permitting efficient retention of the loose leaf binder sheets in the form of an assembled pad and yet permitting each of the sheets to be readily separated from the pad as desired.

As shown in FIG. 6, a pad of paper is illustrated generally at 50 having multiple sheets 52 of paper stacked in pad form. Each of sheets 52 defines a row of closely spaced holes 54 along the upper edge 54 thereof. The holes of the stacked sheets are in registry and thus define corresponding holes extending through the pad 50. Each of the holes 54 of the pad is at least partially lined with adhesive material in the manner discussed above in connection with FIGS. 1–5, with the adhesive material securing the sheets in releasable assembly. The various paper sheets of the resulting pad 50 are releasably adhered to one another by the adhesive which is in contact with each paper sheet only at the holes 54. The edges of the sheets will remain sharp and straight when removed from the pad.

In each case as shown in FIGS. 1–6, no cement spine is employed at the inner edges of the sheets. Thus the inner edges remain sharp and straight even after separation thereof from the adhesive bound pad. These straight sharp edges permit the sheets to be easily handled by copy machines and facsimile machines and thus represents a highly desirable aspect of the present invention. Writing paper pads having holes for adhesive attachment may be constructed and utilized in the same manner. Multiple very small holes located along one of the upper, lower or side edges may be lined with adhesive to secure sheets in releasable assembly.

According to the present invention the method by which adhesive bound pads of loose leaf binder paper or other paper are manufactured is by first assembling a selected number of sheets of paper into a stack, with the respective edges thereof in registry or with at least the inner edges in registry. After this has been done holes are formed along one edge of the stack of paper typically by drilling or punching thereof. The resulting holes of the stack have a generally cylindrical internal configuration in most cases. A coating of adhesive material is then applied within the holes of the paper stack so as to contact each of the sheets of paper of the stack at the respective holes thereof. The coating may line the entire inner periphery of the holes or it may be applied in strips or bands so as to line only selected portions of the holes. The coating of adhesive material is then permitted to cure or is selectively cured so that it binds all of the sheets of paper into an integral pad. Thereafter, individual sheets of paper may be separated from the pad simply by pulling them away to cause separation of the paper and the binding cement at the respective holes thereof. From the standpoint of assembly, the adhesive material may be applied to spaced locations on opposite sides of the drilled or otherwise formed loose leaf binder holes of the assembled paper stack or along only one side thereof so as to permit the sheets of paper to be easily separated from the adhesive bound pad. The adhesive material may be applied in spaced strips within the drilled binder holes to ensure ready, selective separation of the paper sheets from the pad structure. Thus the invention is applicable to pads of loose leaf binder paper, writing paper or any other type of paper.

As mentioned above, the binding cement or other adhesive material utilized for releasably securing the paper sheets in bound assembly to form a loosely binder pad with the binding cement forming reinforcement of the paper immediately about the loose leaf binder holes of individual sheets or about selected portions of the binder holes. The resulting loose leaf binder pad includes sheets of paper that are efficiently bound in releasable assembly and yet are readily separated from the pad. The inner edges of the sheets remain straight and sharp and, as desired, the paper is reinforced immediately at the loose leaf binder holes.

Since certain changes or modifications may be made in the disclosed embodiment without departing from the inventive concepts involved, it is the aim of the appended claims to cover all such changes and modifications falling within the true spirit and scope of the present invention.

What is claimed is:

1. A method for the manufacture of an adhesive bound pad of paper from which the sheets thereof are removable in serial manner, comprising:

(a) assembling a selected number of sheets of paper into a stack so that said sheets of paper collectively define at least one edge of said stack;

(b) forming holes in said stack of sheets along said at least one edge of said stack, said holes being collectively defined by registering holes in each of said sheets, each of said holes being defined by exposed edges of said sheets at said holes; and (c) applying adhesive material to said exposed edges of said sheets within said holes of said stack so as to establish adhesive contact with each sheet of paper only at said exposed edges of said holes thereof to thus adhesively secure said sheets of paper in releasable assembly with one another to form said adhesive bound pad from which individual sheets may be selectively separated.

2. The method of claim 1, wherein said applying comprises;

applying said adhesive material to said exposed paper edges within said holes so that said adhesive material is located adjacent said at least one edge of said stack.

3. The method of claim 1, wherein said applying comprises:

(a) applying a first portion of said adhesive material to portions of said exposed paper edges about said holes adjacent said one edge of said stack; and (b) applying a second portion of said adhesive to portions of said exposed edges about said holes being located diametrically opposite said first portion of said adhesive.

4. The method of claim 1, wherein said applying comprises:

applying a plurality of thin strips of adhesive material to said exposed edges at spaced locations within said holes of said stack of sheets, each of said thin strips of adhesive material having adhesive contact with said exposed edges within said holes with each sheet of paper of said stack of sheets.

5. The method of claim 1, including:

(a) applying said adhesive material in the uncured state thereof within said holes of said stack of sheets; and (b) curing said adhesive material.

6. A pad of adhesive bound paper from which sheets are serially removable, comprising:

(a) a plurality of sheets of paper being arranged in a stack and collectively defining an edge of said stack;

(b) holes being defined in said stack along said edge thereof and being spaced from said edge, each of said holes being defined by exposed edges of said sheets of paper; and (c) adhesive material being located within said holes and having adhesive contact with said exposed edges of each of said sheets of paper within said holes, said adhesive material releasably securing said sheets of paper to said stack about said holes to thus define said pad of adhesive bound paper.

7. The adhesive bound pad of paper of claim 6, wherein:

said adhesive material being an integral coating circumscribing said holes of said stack and being in adhesive contact with said exposed edges of said sheets within said holes.

8. A pad of adhesive bound paper, comprising:

(a) a plurality of sheets of paper being arranged in a stack and defining an edge of said stack;

(b) holes being defined in said stack along said edge and being spaced from said edge, said holes having first exposed edge portions adjacent said edge of said stack and second exposed edge portions defining portions of said holes opposite said first exposed edge portions; and (c) adhesive material being located within said holes and having adhesive contact with each of said sheets of paper, said adhesive material coating only said first exposed edge portions of said holes and releasably securing said sheets of paper to said stack to thus define said paid.

9. The adhesive bound pad of paper of claim 8, wherein:

said adhesive material defines a first adhesive strip coating and first edge portions of said holes and defines a second adhesive strip spaced from said first layer and coating said second edge portions of said holes.

10. The adhesive bound pad of paper of claim 6, wherein:

said adhesive material defines a plurality of spaced strips of adhesive material located within said holes, each of said plurality of spaced strips of adhesive material having adhesive contact within said holes with said exposed edges of each of said sheets of paper of said stack.

11. The adhesive bound pad of paper of claim 6, wherein:

said adhesive material establishing reinforcement for each of said holes of each of said sheets of paper.

12. The adhesive bound pad of paper of claim 6, wherein:

said adhesive material in contact with each sheet of said paper at the respective holes thereof remains in adhesive assembly with said sheet and defines adhesive reinforcement of said sheet of paper about said holes.

13. A pad of adhesive bound paper comprising:

(a) a plurality of sheets of paper being arranged in a stack and defining an edge of said stack;

(b) holes being defined in said stack along one edge thereof and being spaced from said edge;

(c) adhesive material being located within said holes and having adhesive contact with each of said sheets of paper, said adhesive material releasably securing said sheets of paper to said stack to thus define said pad.

(d) said holes having first edge portions adjacent said edge of said stack and second edge portions defining portions of said holes opposite said first edge portions; and (e) said adhesive material coating only said first edge portions of said holes.

14. The pad of adhesive bound paper of claim 13, wherein:

said adhesive material defines a first adhesive strip coating and first edge portions of said holes and defines a second adhesive strip spaced from said first layer and coating said second edge portions of said holes.

* * * * *